US011745907B2

(12) United States Patent
Chang

(10) Patent No.: US 11,745,907 B2
(45) Date of Patent: Sep. 5, 2023

(54) CLAMPING AND CONVEYING DEVICE FOR MATERIAL BAG FILLING SYSTEM

(71) Applicant: Pao-Chung Chang, Taichung (TW)

(72) Inventor: Pao-Chung Chang, Taichung (TW)

(73) Assignee: Hon Buohb Co., Ltd., Taichung (TW)

( * ) Notice: Subject to any disclaimer, the term of this patent is extended or adjusted under 35 U.S.C. 154(b) by 462 days.

(21) Appl. No.: 17/149,723

(22) Filed: Jan. 15, 2021

(65) Prior Publication Data

US 2021/0276753 A1 Sep. 9, 2021

(30) Foreign Application Priority Data

Mar. 9, 2020 (TW) ..... 109107573

(51) Int. Cl.
*B65B 43/46* (2006.01)
*B65B 37/14* (2006.01)
*B65B 43/52* (2006.01)

(52) U.S. Cl.
CPC ..... *B65B 43/465* (2013.01); *B65B 37/14* (2013.01); *B65B 43/52* (2013.01)

(58) Field of Classification Search
CPC ..... B65B 43/46; B65B 43/465; B65B 43/42; B65B 43/52
See application file for complete search history.

(56) References Cited

U.S. PATENT DOCUMENTS 2,671,585 A * 3/1954 Kindseth ..... B65B 51/07 248/101
5,036,893 A * 8/1991 DeCrane ..... B65B 67/1227 141/10
6,089,283 A * 7/2000 Sienerth ..... B65B 43/46 141/73
2002/0040567 A1* 4/2002 Morris ..... B65B 43/465 53/570
2002/0083684 A1* 7/2002 Schlosser ..... B65B 39/14 53/459

FOREIGN PATENT DOCUMENTS

CN 112046872 A * 12/2020
CN 112173257 A * 1/2021

* cited by examiner

*Primary Examiner* — Christopher R Harmon

(57) ABSTRACT

A clamping and conveying device for a material bag filling system is provided. Through displacement of X-axis rails and a Z-axis rail and rotation of rotating arms, grippers can be rotated and inserted into a filling tube portion of a material bag. Cantilevers can be moved away from each other for the filling tube portion to be stretched. Through the rotation and return of the rotating arms, the displacement of the cantilevers and the clamping action of the grippers, the filling tube portion is clamped stably. The cantilevers are displaced to the bottom of the material filling device by the Z-axis rail and the X-axis rails. The filling tube of the material filling device is displaced to enter the material bag for blowing air and filling the material. Through a conveyor belt, the material bag with the filled material is conveyed to a sealing device for sealing.

9 Claims, 15 Drawing Sheets

CLAMPING AND CONVEYING DEVICE FOR MATERIAL BAG FILLING SYSTEM

FIELD OF THE INVENTION

The present invention relates to a clamping and conveying device, and more particularly to a clamping and conveying device for a material bag filling system.

BACKGROUND OF THE INVENTION

A conventional material bag filling system comprises at least one material bag. The filling and packaging of the material bag are completed through a bag clamping device, a material filling device and a sealing device. The upper end of the material bag is provided with a filling tube portion. The bag clamping device is configured to clamp the filling tube portion of the material bag, and then the material bag is conveyed to be under a filling tube of the material filling device. The filling tube is inserted into the material bag for inflation and filling, and then the material bag is sealed by the sealing device.

However, for the conventional bag clamping device, the material bag is sleeved onto a clamp manually, which is time-consuming and labor-consuming to increase the cost.

In addition, the opening of the material bag can be opened by vacuum suction through the design of an automatic gripper, and then the clamp of the bag clamping device clamps the material bag. It is not easy to control the vacuum suction of the automatic gripper, and the material bag may fall. The positioning of the gripper is unstable, and the failure rate is very high, so its reliability is low. Accordingly, the inventor of the present invention has devoted himself based on his many years of practical experiences to solve these problems.

SUMMARY OF THE INVENTION

The primary object of the present invention is to provide a clamping and conveying device for a material bag filling system, comprising at least one material bag. An upper end of the material bag is provided with a filling tube portion. Filling and packaging of the material bag are completed by a bag clamping device, a material filling device and a sealing device. A direction extending along a length of the material bag is defined as an X direction. A direction extending along a width of the material bag is defined as a Y direction. A direction extending along a height of the material bag is defined as a Z direction.

The bag clamping device includes at least one pair of X-axis rails that are disposed on a wall and parallel to the X direction, at least one Z-axis rail slidable along the pair of X-axis rails, a Y-axis rail slidable along the Z-axis rail, a pair of cantilevers slidable along the Y-axis rail, a pair of rotating arms that are driven by rotating rods of the pair of cantilevers to rotate, and a pair of grippers arranged in the pair of rotating arms.

With the above structure, the grippers can be moved up and down on the X-axis rails and the Z-axis rail, and the pair of rotating arms can perform a relative rotation, so that the pair of grippers can be rotated and inserted into the bottom end of the filling tube portion of the material bag. Then, the pair of cantilevers is moved away from each other for the filling tube portion of the material bag to be stretched. Through the rotation and return of the pair of rotating arms, the displacement of the pair of cantilevers and the clamping action of the grippers, the filling tube portion is clamped stably, thereby achieving the benefits of labor saving or stable clamping. Next, the pair of cantilevers is displaced to the bottom of the material filling device by the Z-axis rail and the pair of X-axis rails. The filling tube of the material filling device is displaced in the Z direction to enter the material bag from the filling tube portion of the material bag for blowing air and filling the material. Then, through a conveyor belt displaced in the X direction at its bottom, the material bag with the filled material is conveyed to the sealing device for sealing, so as to complete the packaging.

Preferably, each gripper includes a movable plate that is actuated and pressed by a power source and a downward-pressing plate relative to the movable plate. The power source is disposed on one end face of the gripper. The movable plate is an L-shaped plate and is pivotally connected to the inside of the gripper. The downward-pressing plate is disposed on another end face of the gripper. The power source is actuated to press the L-shaped movable plate downward, and correspondingly press the inner surface of the downward-pressing plate, so as to tightly clamp the filling tube portion of the material bag.

Preferably, the Y-axis rail is provided with a Y-axis bidirectional screw rod that is actuated by a Y-axis motor; the pair of X-axis rails drives two X-axis screw rods through at least one X-axis motor to displace the Z-axis rail; the at least one Z-axis rail drives a Z-axis screw rod through at least one Z-axis motor to displace the Y-axis rail. Through the rotation of the X-axis screw rods and the Z-axis screw rod and the Y-axis motor to control the Y-axis bidirectional screw rod, the pair of cantilevers is operated to move in the X direction and in the Z direction and to move back and forth in the Y direction, so as to achieve precise distance control.

Preferably, a timing belt is provided between the pair of X-axis rails to synchronize the two X-axis screw rods, thereby avoiding the misalignment of the two opposing screw rods.

Preferably, the at least one material bag is stacked on a pallet, so that the pallet and the at least one material bag can be transported through a transport vehicle.

Preferably, the material filling device includes a C-shaped clasp for clasping the filling tube portion of the material bag. When the C-shaped clasp clasps the filling tube portion of the material bag, the pair of rotating arms can be moved away from the material bag in the X direction. When the filling tube of the material filling device starts to fill the material, the material bag is stably positioned.

Preferably, the material filling device is connected with a gas pipe, so that the material bag can be inflated before the filling tube of the material filling device starts to fill the material. It is beneficial for the filling tube to fill the material.

Preferably, the sealing device is a heat sealer for sealing the filling tube portion of the material bag. The filling tube portion of the material bag is tightly sealed by the heat sealer.

Embodiments of the present invention will now be described, by way of example only, with reference to the accompanying drawings.

DETAILED DESCRIPTION OF THE PREFERRED EMBODIMENTS

Figure 1:
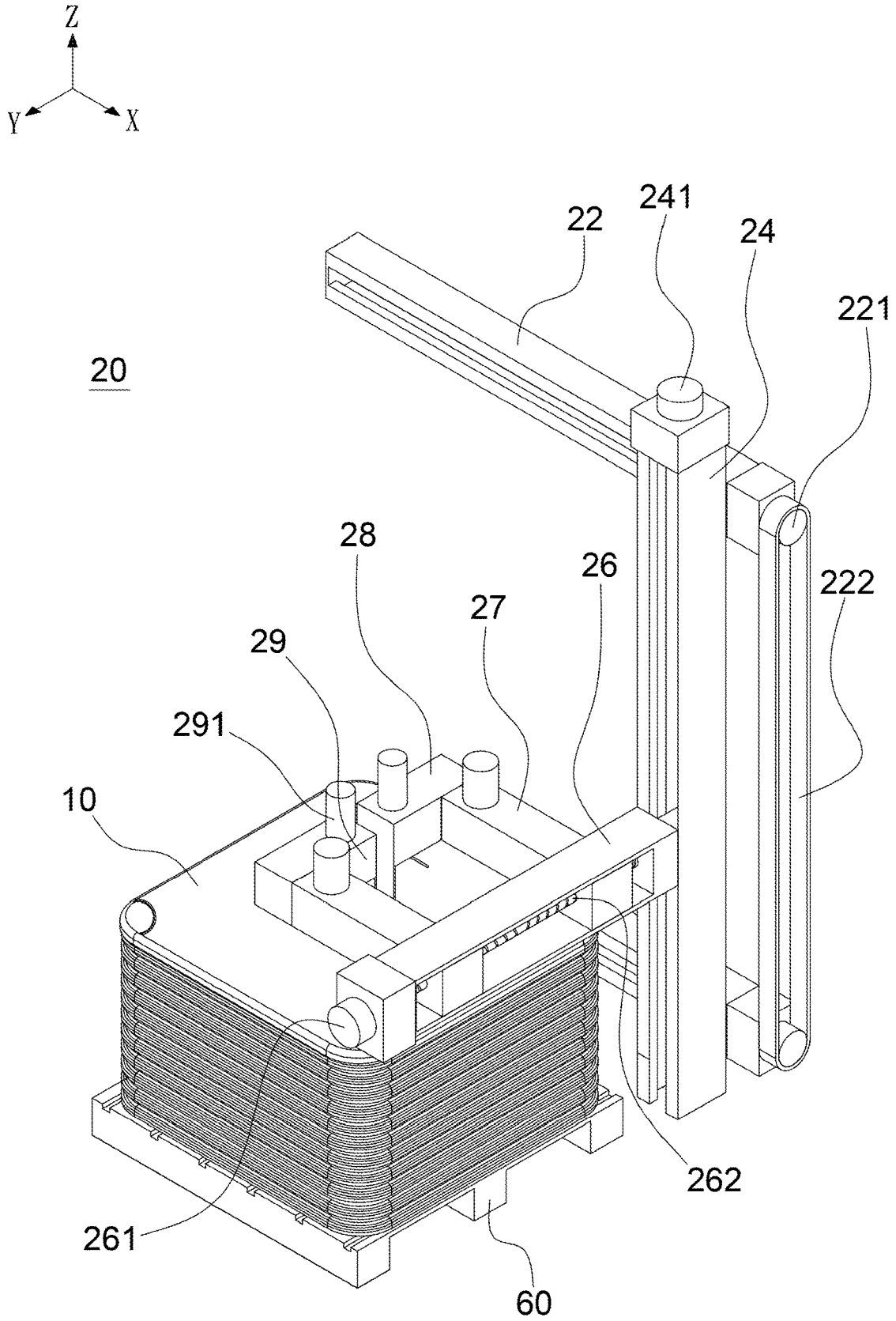
FIG. 1 is a perspective view of the present invention.
Figure 2:
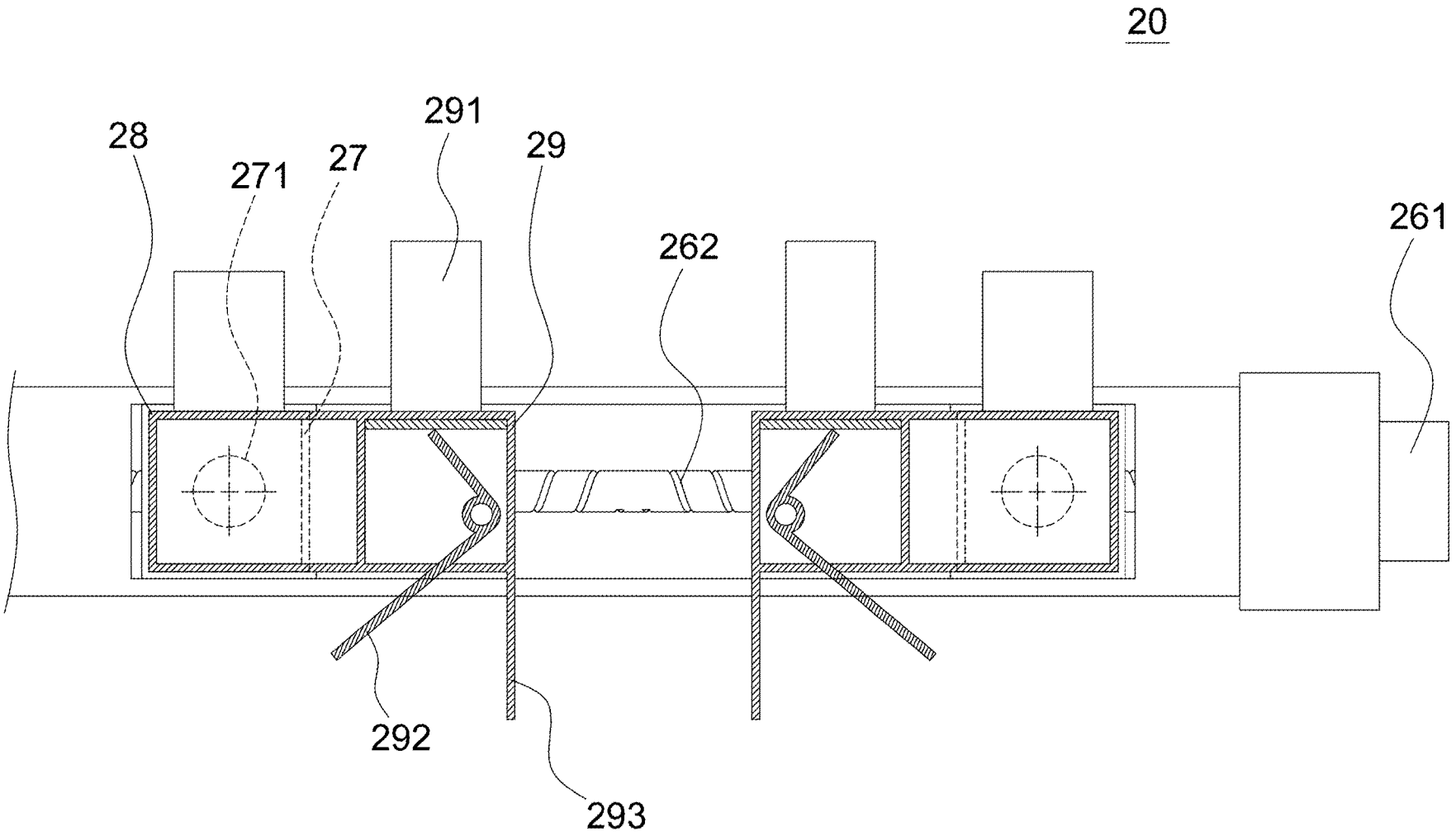
FIG. 2 is a front sectional view of the bag clamping device of the present invention.

Referring to FIG. 1 and FIG. 2, the present invention provides a clamping and conveying device for a material bag filling system, comprising at least one material bag 10. A filling tube portion 11 is provided on the upper end of the material bag 10. Filling and packaging of the material bag 10 are completed by a bag clamping device 20, a material filling device 30 and a sealing device 40. A direction extending along the length of the material bag 10 is defined as an X direction. A direction extending along the width of the material bag 10 is defined as a Y direction. A direction extending along the height of the material bag 10 is defined as a Z direction.

The bag clamping device 20 includes at least one pair of X-axis rails 22 that are disposed on the wall and parallel to the X direction, at least one Z-axis rail 24 slidable along the pair of X-axis rails 22, a Y-axis rail 26 slidable along the Z-axis rail 24, a pair of cantilevers 27 slidable along the Y-axis rail 26, a pair of rotating arms 28 (electrically controlled by pneumatic cylinders, hydraulic cylinders or motors) that are driven by rotating rods 271 of the pair of cantilevers 27 to rotate, and a pair of grippers 29 arranged in the pair of rotating arms 28.

Figure 3:
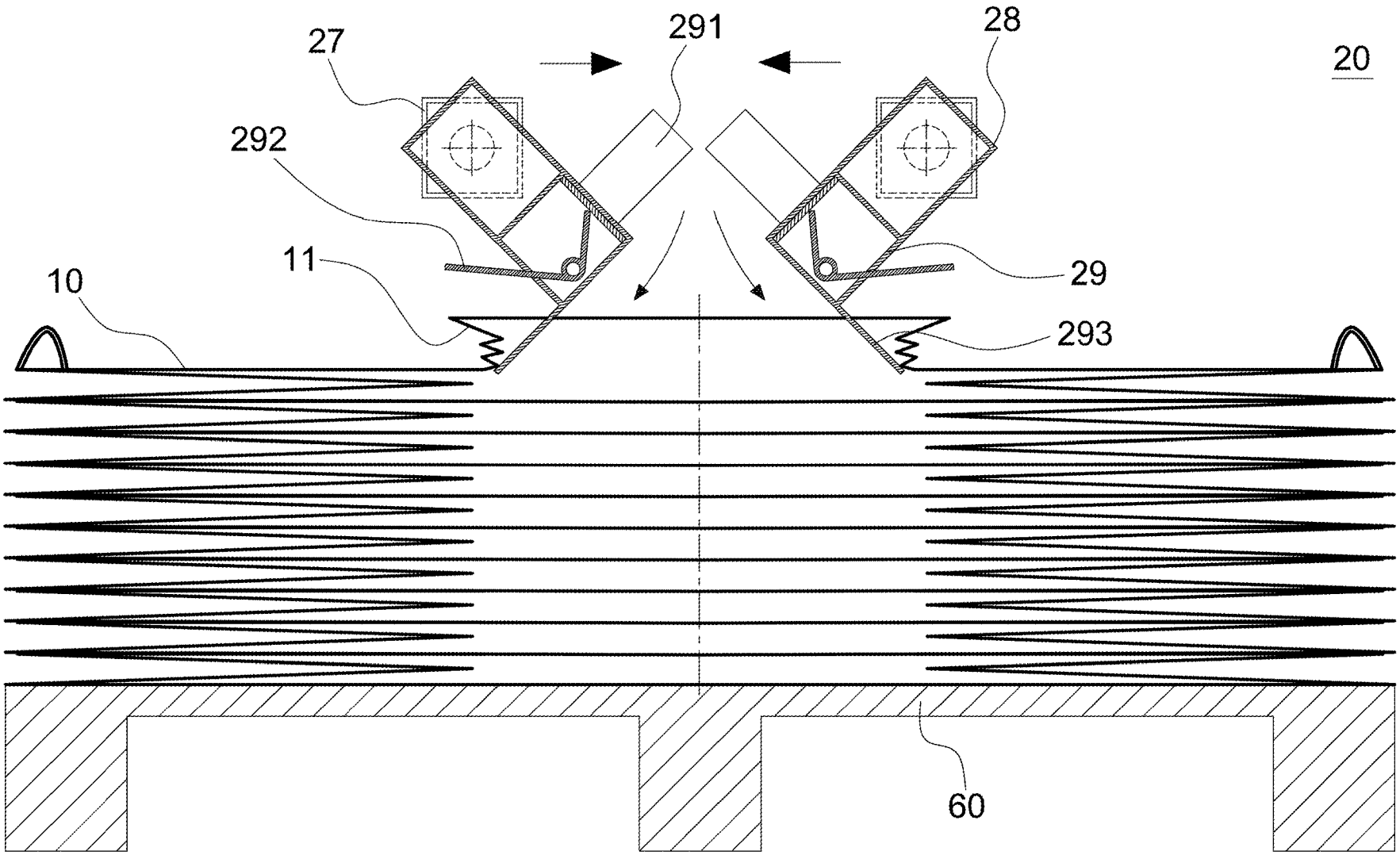
FIG. 3 is a front schematic view of the bag clamping device to clamp the material bag, illustrating a first action.
Figure 4:
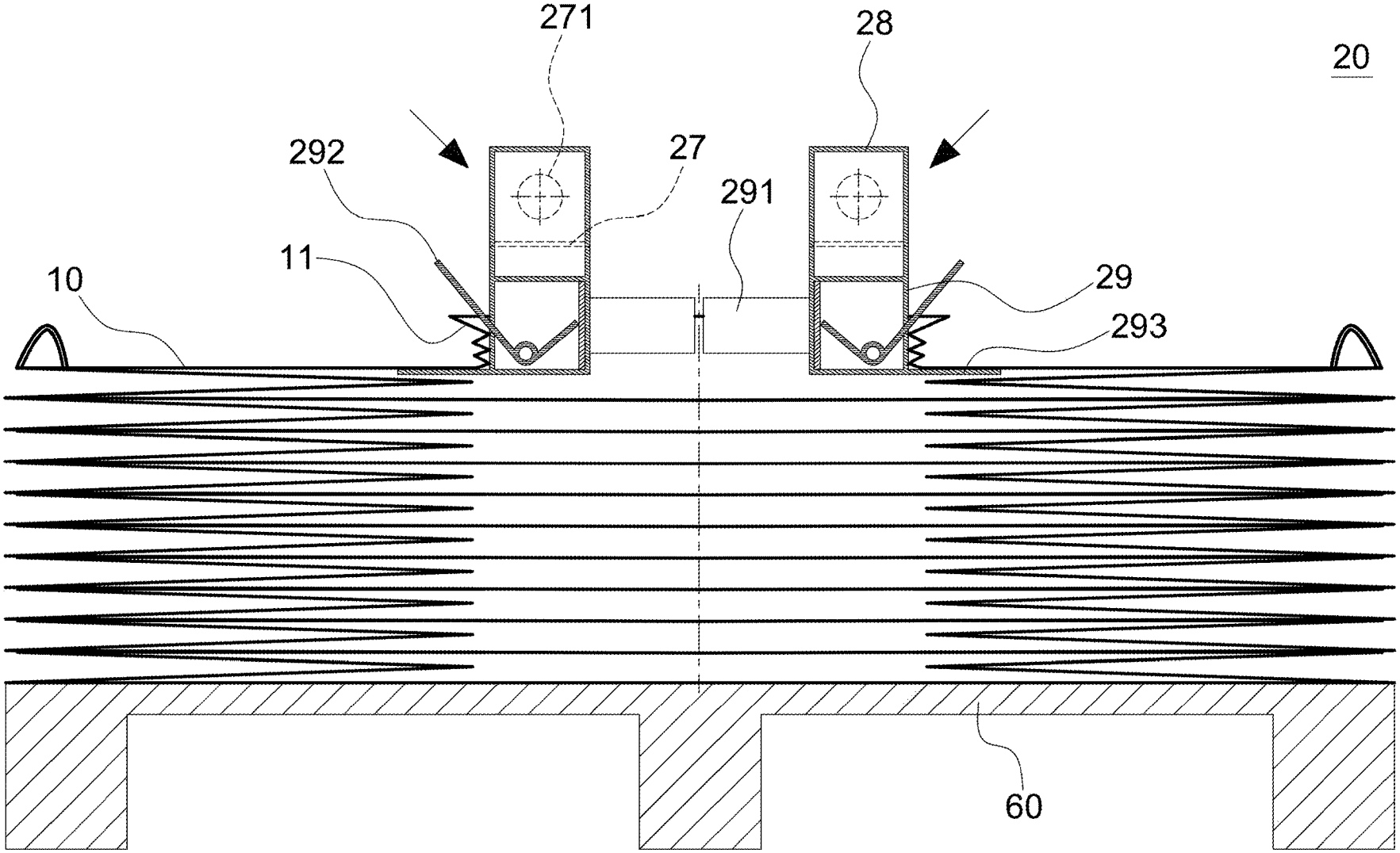
FIG. 4 is a front schematic view of the bag clamping device to clamp the material bag, illustrating a second action.
Figure 5:
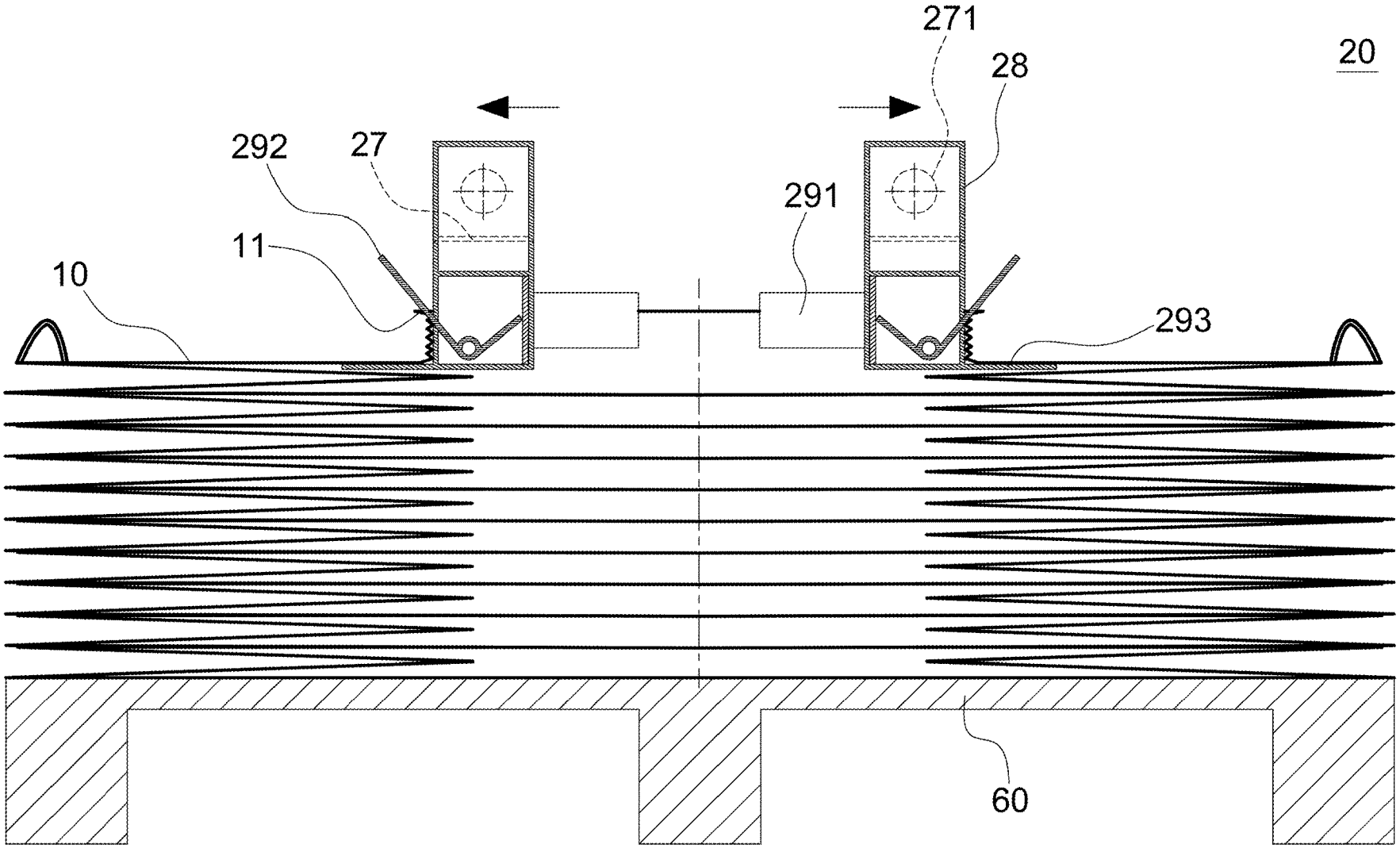
FIG. 5 is a front schematic view of the bag clamping device to clamp the material bag, illustrating a third action.
Figure 6:
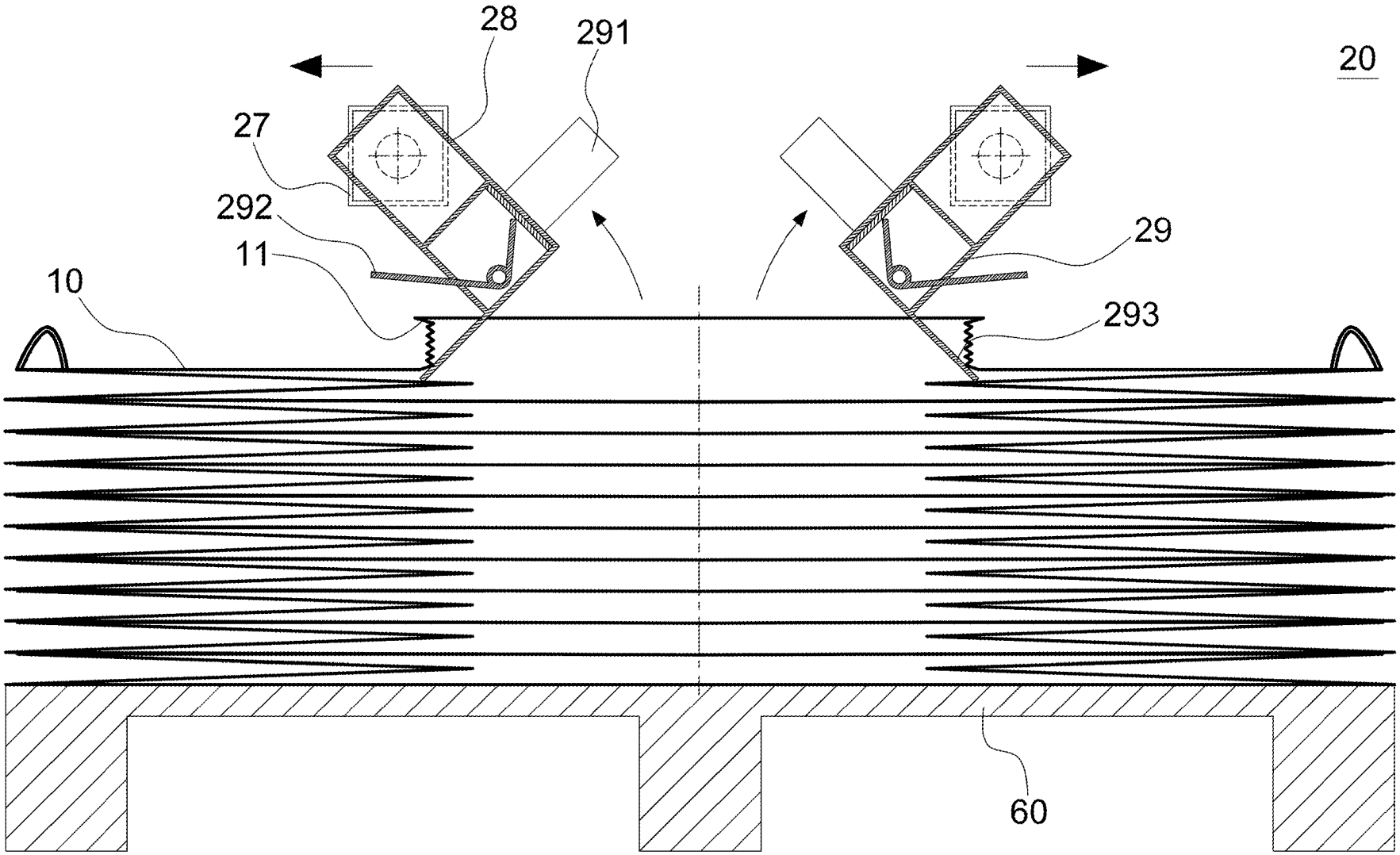
FIG. 6 is a front schematic view of the bag clamping device to clamp the material bag, illustrating a fourth action.
Figure 7:
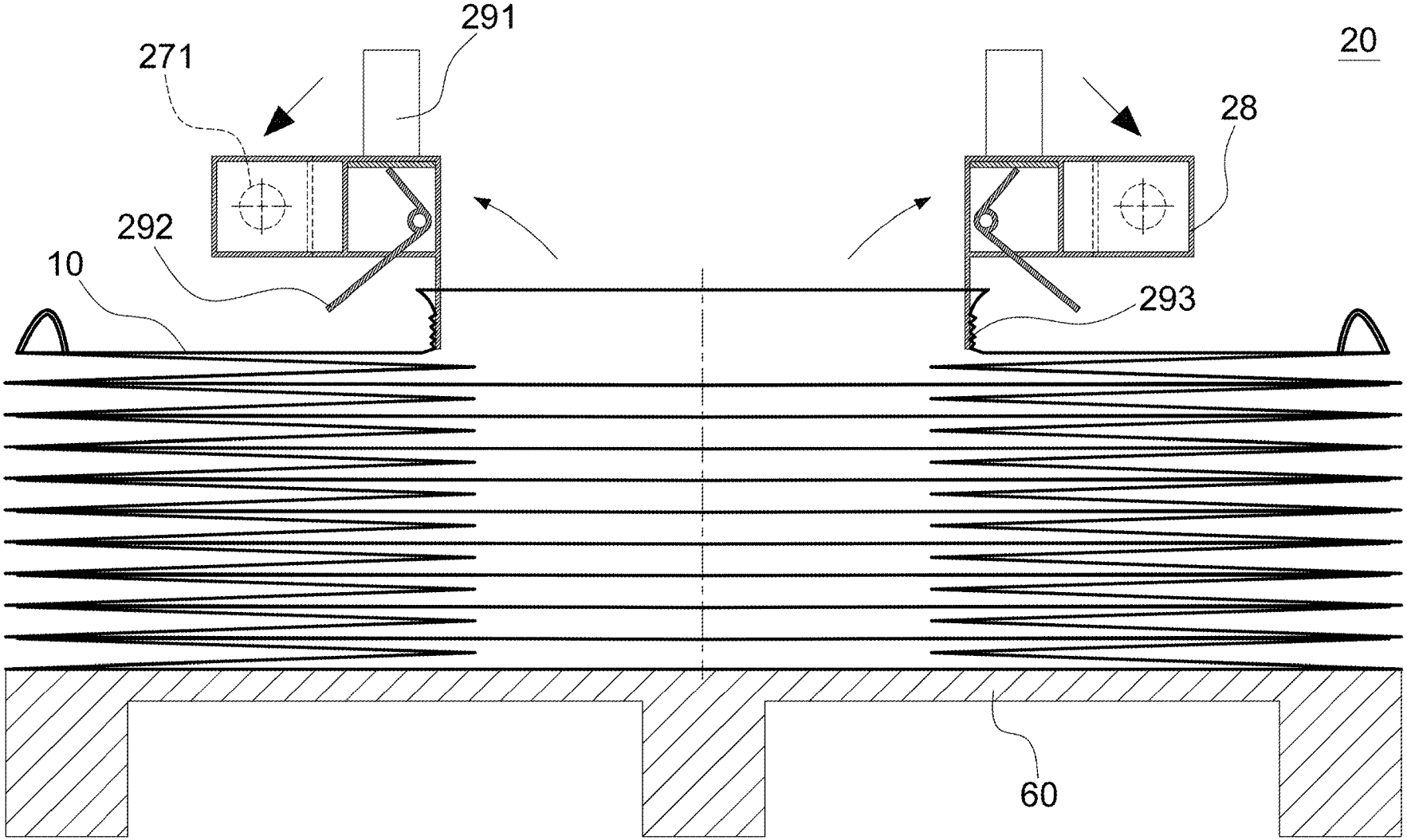
FIG. 7 is a front schematic view of the bag clamping device to clamp the material bag, illustrating a fifth action.
Figure 8:
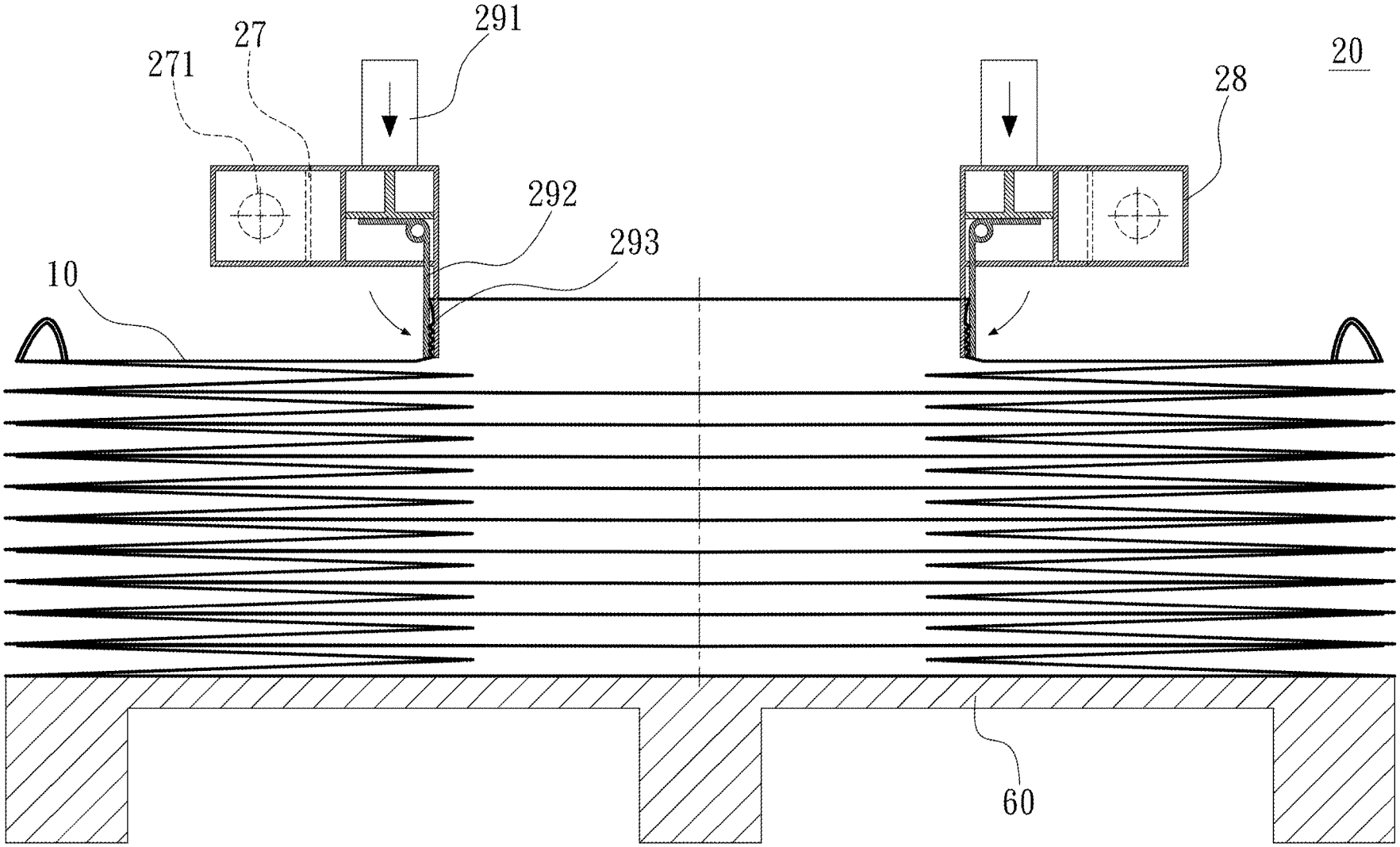
FIG. 8 is a front schematic view of the bag clamping device to clamp the material bag, illustrating a sixth action.
Figure 9:
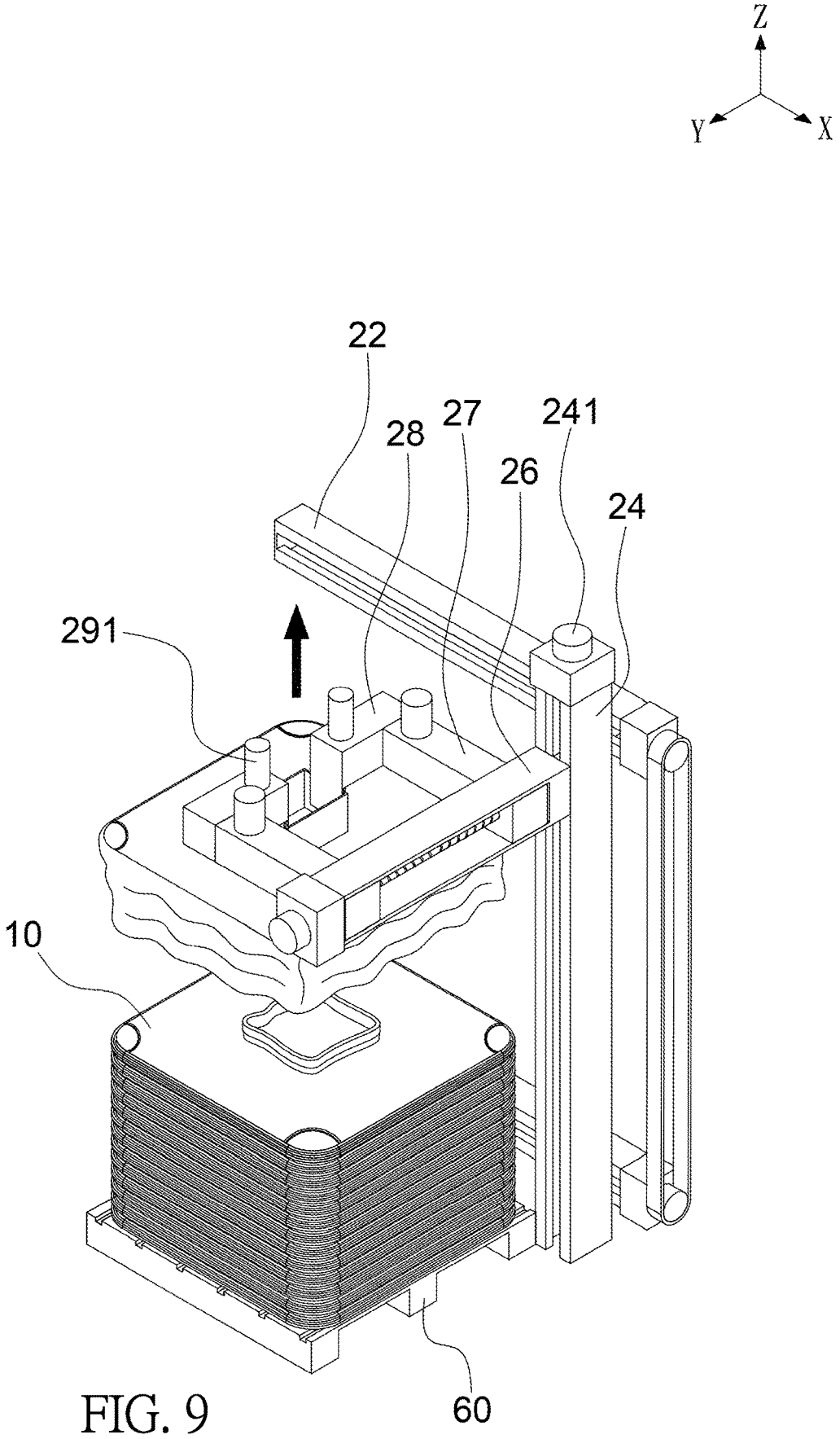
FIG. 9 is a perspective schematic view of the bag clamping device to move in the Z direction, illustrating a seventh action.
Figure 10:
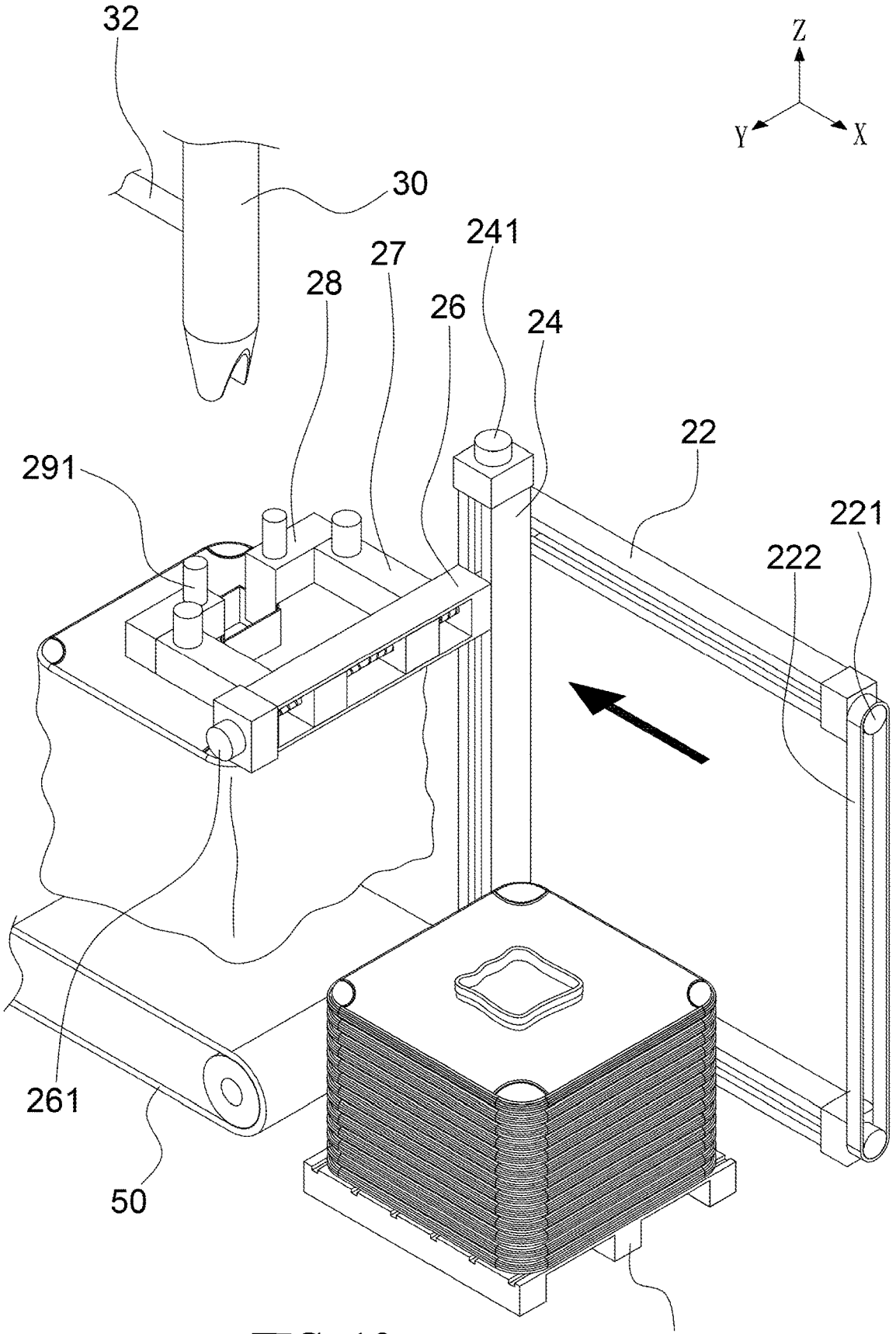
FIG. 10 is a perspective schematic view of the bag clamping device to move in the X direction, illustrating an eighth action.
Figure 11:
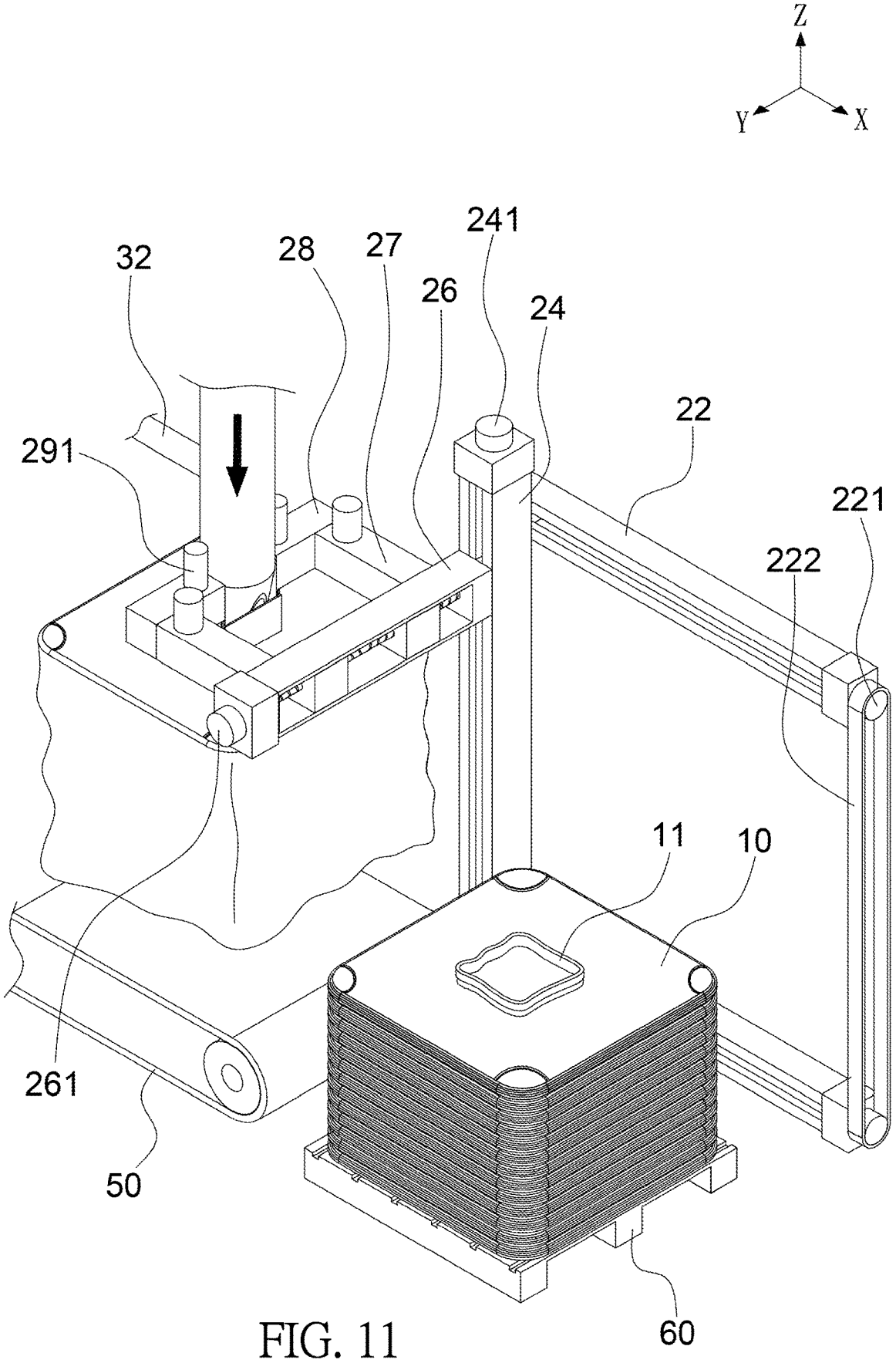
FIG. 11 is a perspective schematic view of the material filling device to move in the Z direction, illustrating a ninth action.
Figure 12:
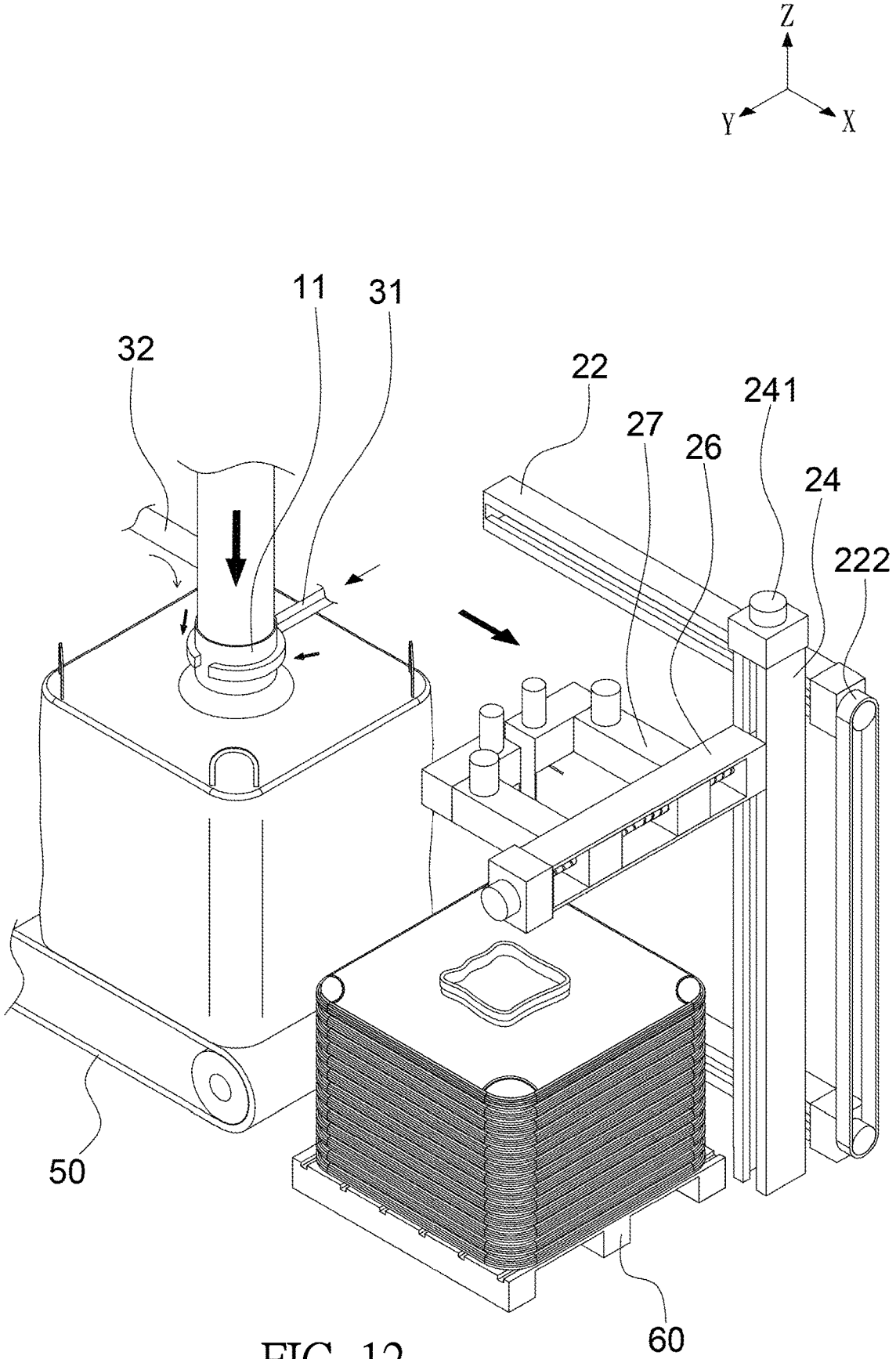
FIG. 12 is a perspective schematic view showing the operation of the C-shaped clasp and the return of the bag clamping device, illustrating a tenth action.
Figure 13:
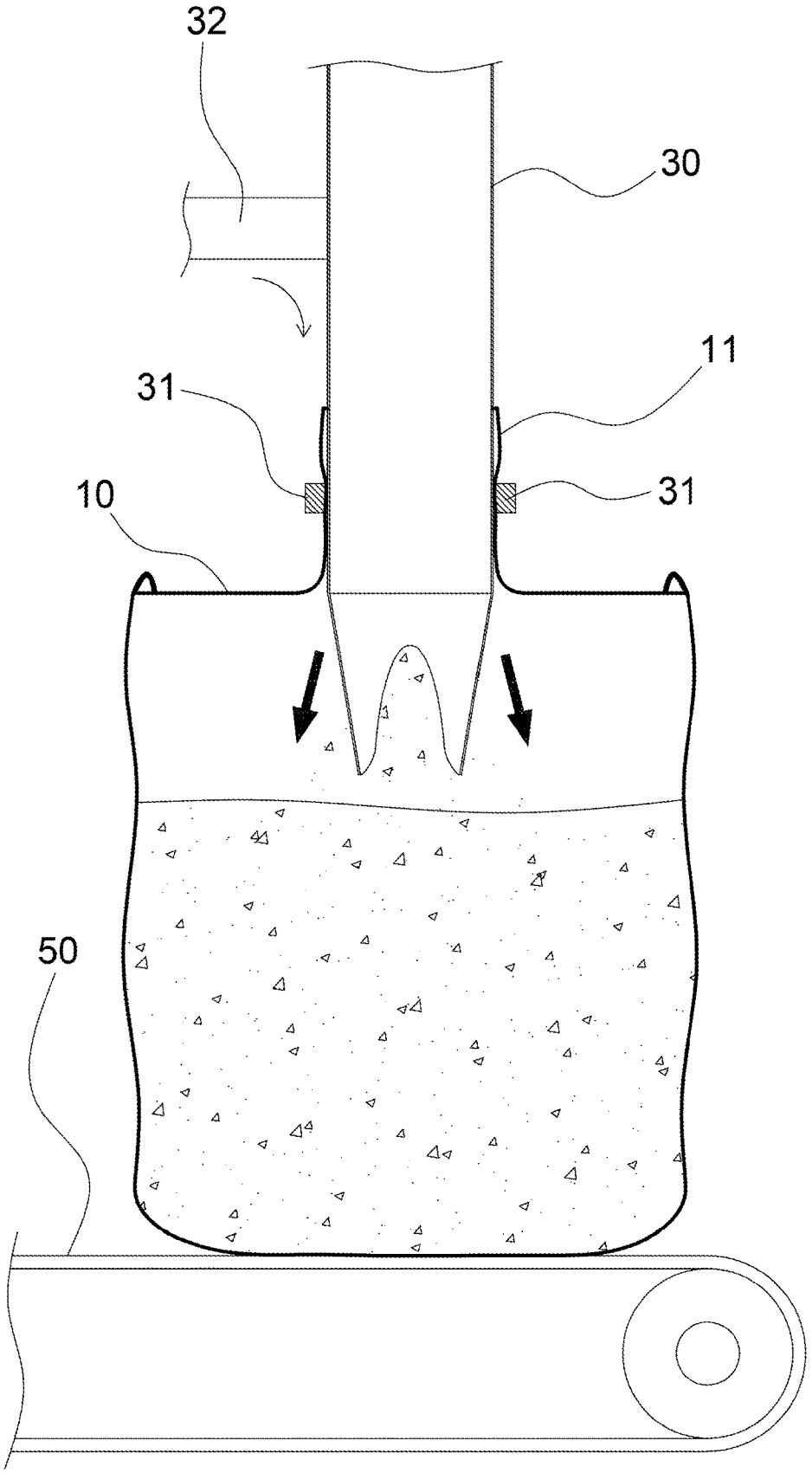
FIG. 13 is a front schematic view of the material filling device to fill the material, illustrating an eleventh action.
Figure 14:
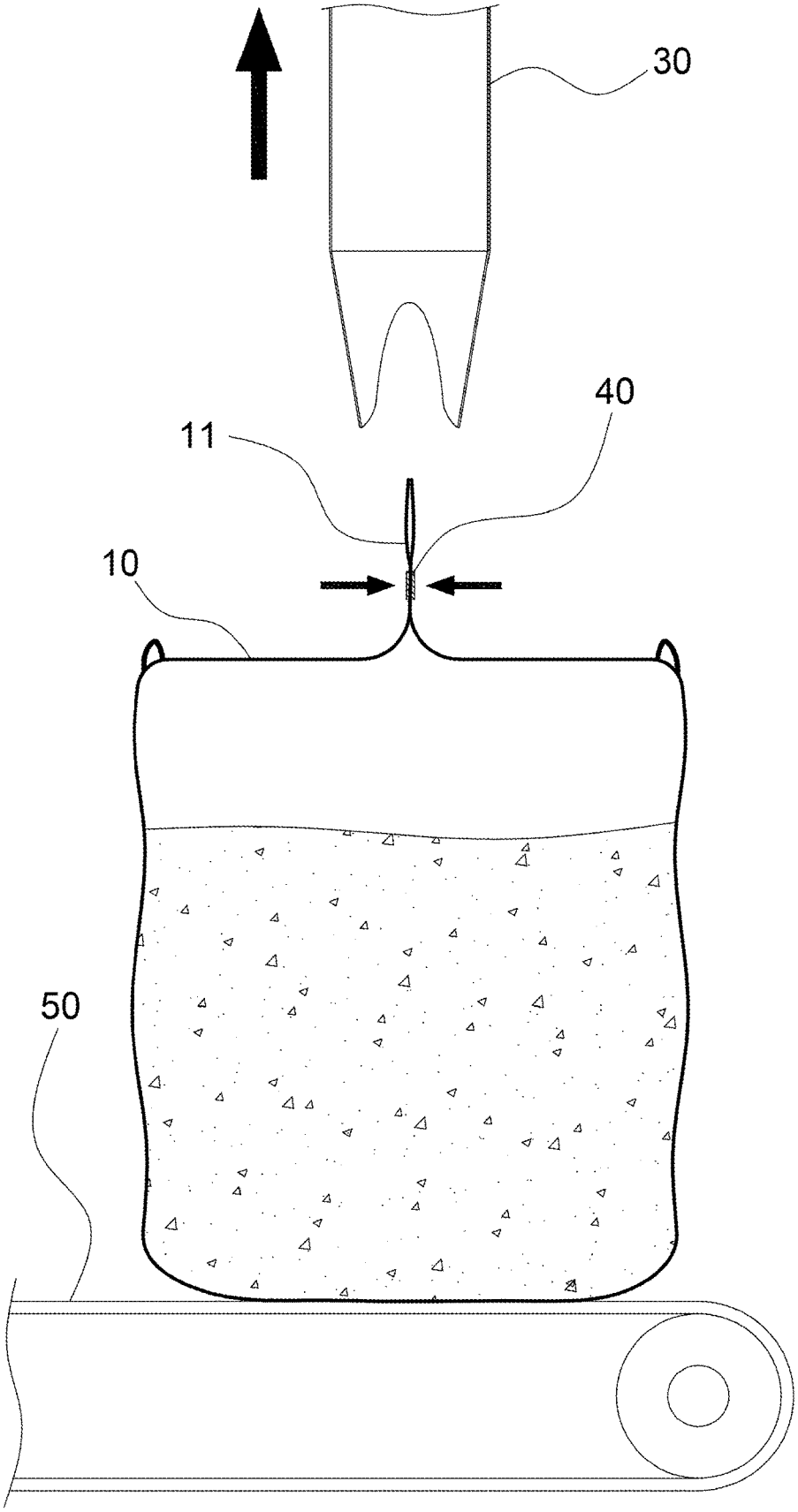
FIG. 14 is a front schematic view of the sealing device to seal the material bag, illustrating a twelfth action.
Figure 15:
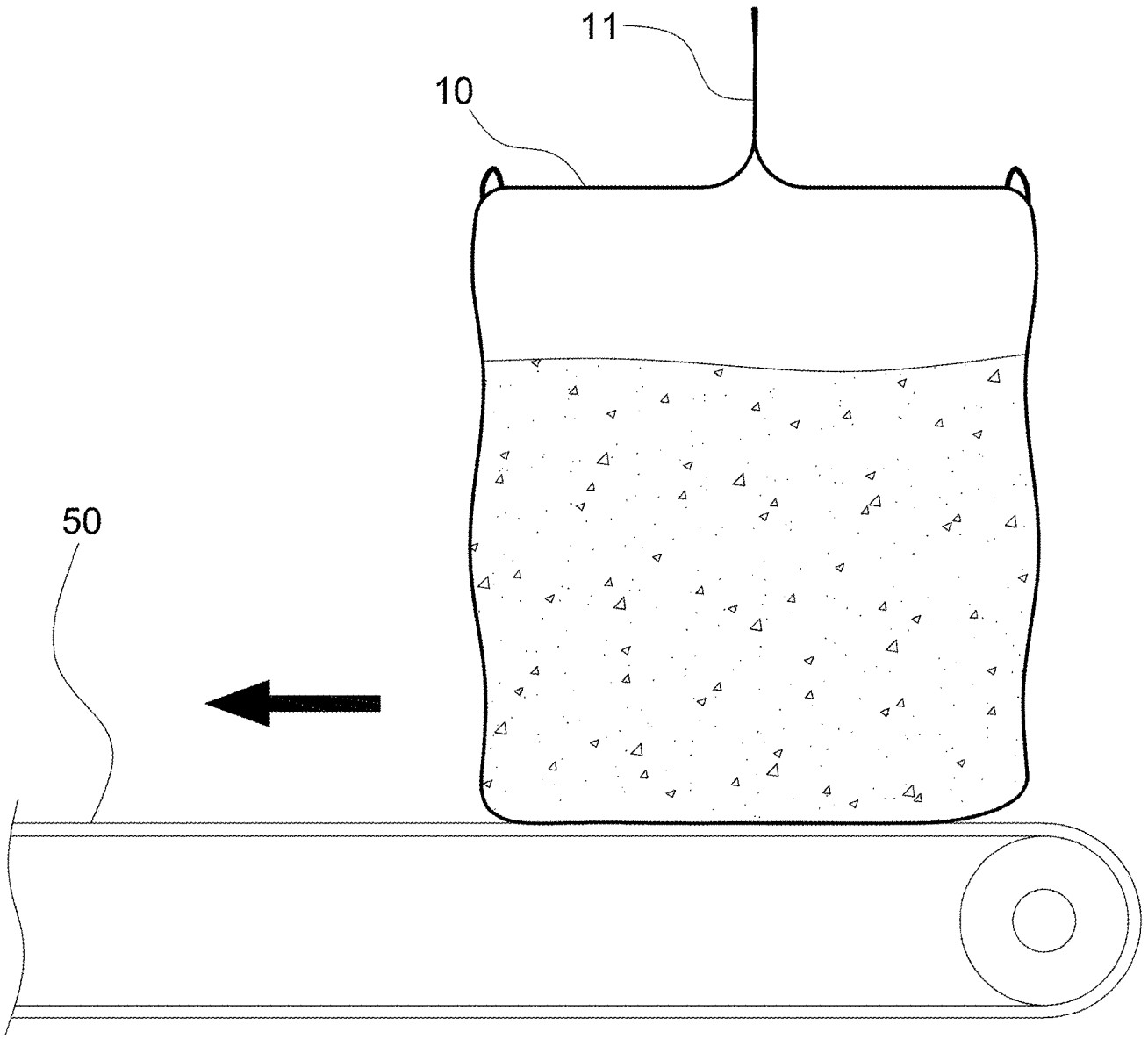
FIG. 15 is a front schematic view of the conveyor belt to convey the material bag, illustrating a thirteenth action.

With the above structure, the grippers 29 can be moved up and down on the X-axis rails 22 and the Z-axis rail 24, and the pair of rotating arms 28 can perform a relative rotation (as shown in FIG. 3), so that the pair of grippers 29 can be rotated and inserted into the bottom end of the filling tube portion 11 of the material bag 10 (as shown in FIG. 4). Then, the pair of cantilevers 27 are moved away from each other for the filling tube portion 11 of the material bag 10 to be stretched (as shown in FIG. 5). Through the rotation and return of the pair of rotating arms 28 (as shown in FIG. 6), the displacement of the pair of cantilevers 27 (as shown in FIG. 7) and the clamping action of the grippers 29 (as shown in FIG. 8), the filling tube portion 11 is clamped stably, thereby achieving the benefits of labor saving or stable clamping. Next, the pair of cantilevers 27 is displaced to the bottom of the material filling device 30 (as shown in FIG. 9 and FIG. 10) by the Z-axis rail 24 and the pair of X-axis rails 22. The filling tube of the material filling device 30 is displaced in the Z direction (as shown in FIG. 11) to enter the material bag 10 from the filling tube portion 11 of the material bag 10 for blowing air and filling the material (as shown in FIG. 12 and FIG. 13). Then, through a conveyor belt 50 (as shown in FIG. 14 and FIG. 15) displaced in the X direction at its bottom, the material bag 10 with the filled material is conveyed to the sealing device 40 for sealing, so as to complete the packaging.

As shown in FIG. 1 and FIG. 2, each gripper 29 includes a movable plate 292 that is actuated and pressed by a power source 291 (a pneumatic cylinder, a hydraulic cylinder or a motor) and a downward-pressing plate 293 relative to the movable plate 292. The power source 291 is disposed on one end face of the gripper 29. The movable plate 292 is an L-shaped plate and is pivotally connected to the inside of the gripper 29. The downward-pressing plate 293 is disposed on another end face of the gripper 29. The power source 291 is actuated to press the L-shaped movable plate 292 downward, and correspondingly press the inner surface of the downward-pressing plate 293, so as to tightly clamp the filling tube portion 11 of the material bag 10.

The Y-axis rail 26 is provided with a Y-axis bidirectional screw rod 262 that is actuated by a Y-axis motor 261; the pair of X-axis rails 22 drives two X-axis screw rods through at least one X-axis motor 221 to displace the Z-axis rail 24; the at least one Z-axis rail 24 drives a Z-axis screw rod through at least one Z-axis motor 241 to displace the Y-axis rail 26. Through the rotation of the X-axis screw rods and the Z-axis screw rod and the Y-axis motor 261 to control the Y-axis bidirectional screw rod 262, the pair of cantilevers 27 is operated to move in the X direction and in the Z direction and to move back and forth in the Y direction, so as to achieve precise distance control.

Preferably, as shown in FIGS. 9 to 12, a timing belt 222 is provided between the pair of X-axis rails 22 to synchronize the two X-axis screw rods, thereby avoiding the misalignment of the two opposing screw rods. In another implementation, the screw rods of the pair of X-axis rails 22 are controlled to rotate synchronously through a computer (not shown).

In the implementation of the present invention, the material bags 10 are stacked on a pallet 60, so that the pallet 60 and the plurality of material bags 10 can be transported through a transport vehicle (forklift).

Please refer to FIG. 12 and FIG. 13. In detail, the material filling device 30 includes a C-shaped clasp 31 for clasping the filling tube portion 11 of the material bag 10. When the C-shaped clasp 31 clasps the filling tube portion 11 of the material bag 10, the pair of rotating arms 28 can be moved away from the material bag 10 in the X direction. When the filling tube of the material filling device 30 starts to fill the material, the material bag 10 is stably positioned.

In addition, referring to FIG. 12, FIG. 13 and FIG. 14, the material filling device 30 is connected with a gas pipe 32, so that the material bag 10 can be inflated before the filling tube of the material filling device 30 starts to fill the material. It is beneficial for the filling tube to fill the material.

Finally, as shown in FIG. 14, the sealing device 40 is a heat sealer (which may be a V-shaped sealer) for sealing the filling tube portion 11 of the material bag 10. The filling tube portion 11 of the material bag 10 is tightly sealed by the heat sealer.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A clamping and conveying device for a material bag filling system, comprising at least one material bag, an upper end of the material bag being provided with a filling tube portion, filling and packaging of the material bag being completed by a bag clamping device, a material filling device and a sealing device, a direction extending along a length of the material bag being defined as an X direction, a direction extending along a width of the material bag being defined as a Y direction, a direction extending along a height of the material bag being defined as a Z direction;

the bag clamping device including at least one pair of X-axis rails that are disposed on a wall and parallel to the X direction, at least one Z-axis rail slidable along the pair of X-axis rails, a Y-axis rail slidable along the Z-axis rail, a pair of cantilevers slidable along the Y-axis rail, a pair of rotating arms that are rotatable on the pair of cantilevers, and a pair of grippers arranged in the pair of rotating arms.

2. The clamping and conveying device as claimed in claim 1, wherein each gripper includes a movable plate that is actuated and pressed by a power source and a downward-pressing plate relative to the movable plate; the power source is disposed on one end face of each gripper, the movable plate is an L-shaped plate and is pivotally connected to an inside of each gripper, and the downward-pressing plate is disposed on another end face of each gripper.

3. The clamping and conveying device as claimed in claim 2, wherein the power source is a pneumatic cylinder, a hydraulic cylinder or a motor.

4. The clamping and conveying device as claimed in claim 1, wherein the Y-axis rail is provided with a Y-axis bidirectional screw rod that is actuated by a Y-axis motor; the pair of X-axis rails drives two X-axis screw rods through at least one X-axis motor to displace the Z-axis rail; the at least one Z-axis rail drives a Z-axis screw rod through at least one Z-axis motor to displace the Y-axis rail.

5. The clamping and conveying device as claimed in claim 4, wherein a timing belt is provided between the pair of X-axis rails to synchronize the two X-axis screw rods.

6. The clamping and conveying device as claimed in claim 1, wherein the at least one material bag is stacked on a pallet.

7. The clamping and conveying device as claimed in claim 1, wherein the material filling device includes a C-shaped clasp for clasping the filling tube portion of the material bag.

8. The clamping and conveying device as claimed in claim 1, wherein the material filling device is connected with a gas pipe.

9. The clamping and conveying device as claimed in claim 1, wherein the sealing device is a heat sealer for sealing the filling tube portion of the material bag.

* * * * *